United States Patent [19]

Bass

[11] 3,991,996

[45] Nov. 16, 1976

[54] STRIPPING AND TRANSFER ROLLER ASSEMBLY FOR SHEET FILM PROCESSING

[75] Inventor: Larry I. Bass, New Hope, Minn.

[73] Assignee: Pako Corporation, Minneapolis, Minn.

[22] Filed: Jan. 29, 1976

[21] Appl. No.: 653,470

[52] U.S. Cl. ..... 271/80; 271/DIG. 2; 226/5; 226/186; 226/191

[51] Int. Cl.[2] ..... B65H 29/22; B65H 29/54

[58] Field of Search ..... 271/DIG. 2, 80, 174, 271/272, 273, 274, 276; 226/5, 186, 191

[56] References Cited

UNITED STATES PATENTS

| | | | |
|---|---|---|---|
| 3,042,281 | 7/1962 | Balvin | 226/191 X |
| 3,363,816 | 1/1968 | Maddock | 226/186 |
| 3,727,912 | 4/1973 | Vos | 271/276 |

*Primary Examiner*—Robert W. Saifer
*Attorney, Agent, or Firm*—John W. Adams

[57] ABSTRACT

A stripping and transfer roller assembly particularly constructed for use in sheet film processors and which includes a pair of cylindrical rollers positioned in closely spaced relation for driving individual sheets of film through a drier and thereafter transfer the same laterally while in substantially upright position into a receiving bin disposed in close association to said rollers, one roller being hollow and having a plurality of pairs of diametrically opposed openings formed therein in axially spaced relation, soft compressible stripping and transfer elements inserted into said hollow roller and aligned with a pair of said openings and having portions thereof normally extending through said openings and beyond the outer surface of said hollow roller, said portions being radially compressed when said sheet passes between said pair of rollers and which expand as said portions rotate out of contact with said sheet, the expansion of said elements stripping the sheet from the stripping roller, said expanded portions then engaging the trailing edge of each stripped sheet to transport said edge laterally and deliver the sheets into said bin in substantially upstanding position in said bin.

2 Claims, 7 Drawing Figures

STRIPPING AND TRANSFER ROLLER ASSEMBLY FOR SHEET FILM PROCESSING

In the past, two general difficulties have been associated with roller assemblies used in film sheet processors. The first was maintaining good driving contact between the sheet and the rollers without damaging the surface of the film. The second difficulty was in preventing the film from sticking to the rollers and thus damaging the sheet. A problem is also associated with the delivery of the upstanding film sheets into a film receiving bin. The bins are usually mounted to receive the sheets in a substantially upright position. The problem lies in transporting the film in an upright position from the last pair of rollers into said bin.

In a copending U.S. Pat. application Ser. No. 622,093 filed Oct. 14, 1973, and assigned to the instant assignee a pair of rollers are provided with a plurality of soft compressible stripping and transfer elements circumferentially spaced around one of the rollers positioned in closest proximity to a sheet-receiving bin. A sheet of film passes between said stripping roller and the pressure roller adjacent thereto and the leading edge of the sheet slides up the remote side panel of the bin. The elements are radially compressed when rotated into contact with the sheet to provide a good driving contact between the rollers and the sheet of film. When said elements are rotated out of registration with said pressure roller, they radially expand to their original thickness and thus force, or strip, the film away from the one roller. Said expanded elements extend outwardly beyond the roller periphery to provide an abutment for engaging the trailing of said stripped film sheet and are rotated to transfer said trailing edge laterally towards said bin until the trailing edge falls away from the elements and into the sloping bottom of said bin, thereby depositing said stripping sheet in a substantially upright position in the bin. The one difficulty associated with the above stripping and transfer elements is that when said elements are broken off the one roller, due to the transferring of the sheets into the bin, it is very difficult in the field to glue replacement elements onto said one roller.

This invention remedies this difficulty by providing a hollow stripping and transfer roller having a plurality of pairs of diametrically opposed openings formed therein, into which roller are inserted soft, compressible stripping and transfer elements with portions thereof normally extending through said openings and beyond the outer surface of said roller. The elements are slightly wider than the inside diameter of the hollow roller, compressing slightly when inserted thereinto thereby exerting pressure on the inside surface of the roller to ensure continued alignment with said openings. When one of the protruding portions of an element breaks off, the element is easily replaced by merely pushing out that element and inserting a new element into the roller and into alignment with the associated pair of openings.

The details and advantages of this invention will more fully appear from the following description.

Figure 1:
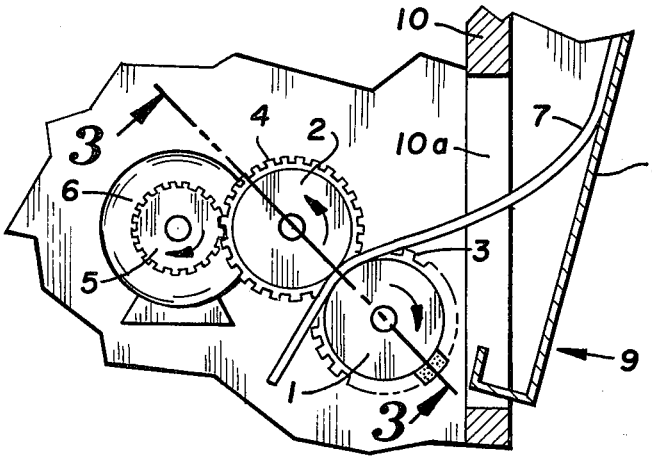
FIG. 1 is a front elevational view of the roller assembly and film sheet-receiving bin.
Figure 2:
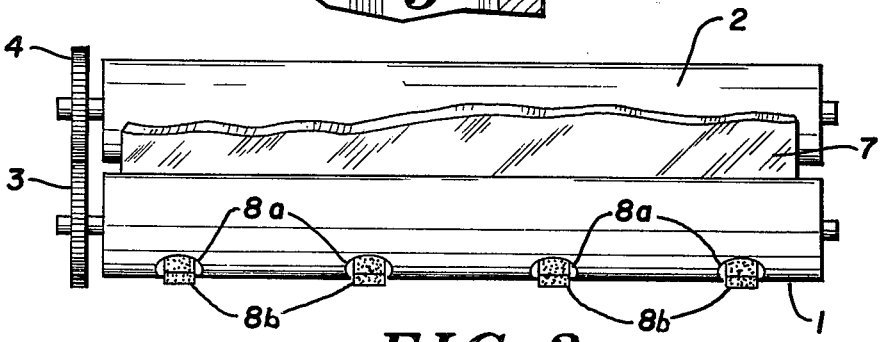
FIG. 2 is a side elevational view of the roller assembly.
Figure 3:
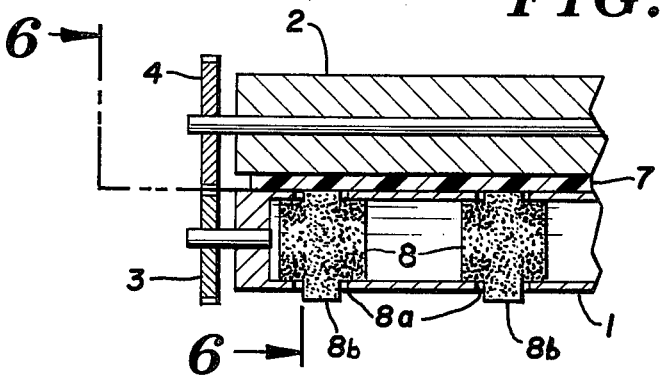
FIG. 3 is a cross-sectional view of the roller assembly taken substantially along the line 3—3 of FIG. 1.
Figure 4:
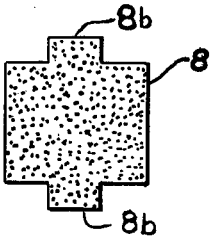
FIG. 4 is a top plan view of a stripping and transfer element.
Figure 5:
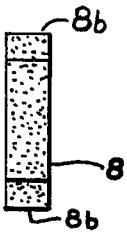
FIG. 5 is a side elevational view of the stripping and transfer element.

Referring to FIG. 1 a pair of rollers 1 and 2 are positioned in closely spaced parallel relation to each other and are interconnected by the pair of meshing gears 3 and 4. Said gear 4 is also meshed with drive gear 5 of motor 6. Said pair of rollers 1 and 2 are closely disposed towards a discharge opening 10*a* of processor wall 10. A plurality of pairs of diametrically opposed openings 8*a* are formed in the hollow roller 1 and as best shown in FIG. 3 a plurality of soft compressible stripping and transfer elements 8 are inserted into the roller 1 and aligned with the openings 8*a* so that portions 8*b* of either end of the elements 8 extend or protrude through the openings 8*a* and beyond the outer surface of roller 1. Said elements 8 are generally cross-shaped as shown in FIGS. 4 and 5, the transverse portions thereof being slightly wider than the inside diameter of roller 1 so that the elements 8 must be somewhat compressed when inserted thereinto. The longitudinal portions of the cross form the outwardly extending stripping and transfer portions of the element. FIG. 3 shows how the transverse portions of the elements 8 compress to conform to the inner surface of roller 1 and ensure continued proper alignment of the longitudinal protruding portions 8*b* with the corresponding openings 8*a*. A generally upstanding film sheet-receiving bin 9 is positioned in closely spaced relation to roller 1 and extends through opening 10*a* of wall 10 and has the side nearest roller 1 open to permit the sheets of film 7 to pass into the bin. A sheet of film 7 is shown positioned between rollers 1 and 2 and in driving contact therewith.

In typical operation, means (not shown) transport sheet 7 into contact with rollers 1 and 2. Motor 6 rotates rollers 1 and 2 and thus drives sheet 7 between rollers 1 and 2 and into contact with the closed, remote panel 9*a* of bin 9.

As the protruding portions 8*b* of elements 8 are rotated into contact with roller 2, they are radially compressed into the openings 8*a* as shown in FIG. 3. The compressed portions 8*b* press upwardly on sheet 7 and provide good frictional driving engagement of sheet 7 by rollers 1 and 2 and portions 8*b*.

As roller 1 is rotated, said portions 8*b* are moved out of contact with roller 2 and expand to their normal thickness. This expansion forces, or strips, sheet 7 from roller 1.

Figure 7:
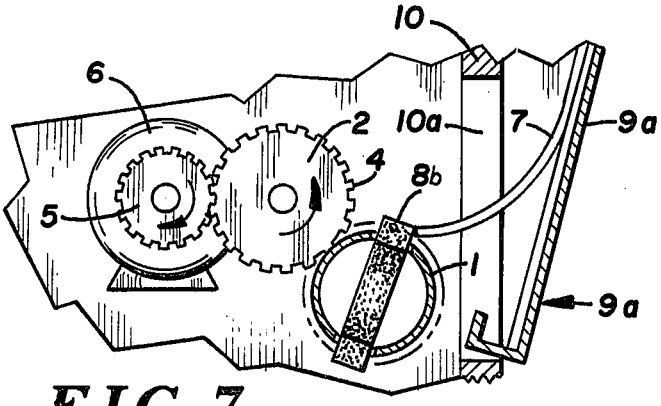
FIG. 7 is a front elevational view of the roller assembly and bin showing the engagement of the trailing edge of a film sheet by the protruding portions of the elements.
Figure 6:
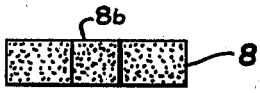
FIG. 6 is a top plan view of the element shown in FIGS. 4 and 5.

Rollers 1 and 2 drive the leading edge of sheet 7 into contact with wall 9*a*, which forces sheet 7 to move upwardly as shown in FIG. 1. When the trailing edge of sheet 7 is driven out of contact with roller 2, it momentarily slips along roller 1 until it engages the protruding portions 8*b*. As roller 1 rotates, the portions of elements 8 in contact with the lower edge move it laterally and towards bin 9, as best shown in FIG. 7. The trailing edge will eventually fall from roller 1 and onto the sloping bottom of bin 9. In this manner sheet 7 is deposited in a generally upright position in bin 9, as shown.

When one of the protruding portions 8*b* of an element 8 breaks off, that element is easily removed from the roller 1 and a new element 8 is slightly compressed to insert it into roller 1 and the protruding portions 8*b* are then aligned with the corresponding openings 8*a* and extend therethrough.

It will, of course, be understood that various changes may be made in the form, details, arrangement and proportion of the parts without departing from the scope of the invention, which generally stated, consists in the matter set forth in the accompanying claims.

What is claimed is:

1. A stripping and transfer roller assembly discharging individual sheets of film from a processing machine and comprising a hollow first roller forming a stripping and transfer roller, said first roller having a plurality of pairs of diametrically opposed openings formed therein in axially spaced relation and lying in an axial plane through said first roller, a soft compressible stripping and transfer element inserted into said hollow roller through each pair of diametrically opposed openings, means for retaining said stripping and transfer elements in operative position within said hollow roller with portions thereof normally respectively extending through said pairs of openings beyond the outer periphery of the roller, a second roller positioned in close parallel relation to said first roller and compressing the outwardly extending portions of said elements when a sheet of film is being driven between said rollers to provide positive frictional driving contact between said sheet and said rollers, a film receiving bin in close side by side relation to said stripping and transfer roller, said rollers driving the upper portion of said sheet into the upper portion of said bin to orient said sheet into a substantially upright position, said elements expanding beyond the periphery of said first roller as they are rotated out of contact with said second roller to strip said sheet from said first roller, and said expanded elements then being rotated into engagement with the trailing lower edge of said stripped sheet to transfer said trailing edge laterally towards said bin and depositing said sheet in upstanding position into said bin.

2. The structure set forth in claim 1 and said stripping and transfer element being generally cross shaped with the transverse portions being slightly larger than portions of the inside of said roller to engage the same and form said means for retaining said stripping and transfer elements in operative position within said roller, the longitudinal portions of the cross forming the outwardly extending stripping and transfer portions of said element.

* * * * *